US007868236B1

(12) United States Patent
Lai

(10) Patent No.: US 7,868,236 B1
(45) Date of Patent: Jan. 11, 2011

(54) DRUM PEDAL ASSEMBLY

(76) Inventor: Mu-Sen Lai, No. 51-4, Fan-Po St., Fan-Po Vil., Fu-Hsin Hsiang, Changhwa Hsien (TW)

( * ) Notice: Subject to any disclaimer, the term of this patent is extended or adjusted under 35 U.S.C. 154(b) by 0 days.

(21) Appl. No.: 12/462,697

(22) Filed: Aug. 6, 2009

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 2,572,613 A * 10/1951 Goff ..... 411/393
3,030,847 A * 4/1962 Thompson ..... 84/422.1
5,365,824 A * 11/1994 Hoshino ..... 84/422.1
5,388,494 A * 2/1995 Hoshino ..... 84/422.1
5,798,472 A * 8/1998 Shigenaga ..... 84/422.1
6,158,110 A * 12/2000 Takacs ..... 29/724
6,259,012 B1 * 7/2001 Hoshino ..... 84/422.1
6,281,418 B1 * 8/2001 Chang ..... 84/422.1
6,538,184 B2 * 3/2003 Hsieh ..... 84/422.1
6,568,063 B1 * 5/2003 Sweeney et al. ..... 29/525.01
6,570,076 B1 * 5/2003 Kjellgren ..... 84/422.1
6,822,149 B1 * 11/2004 Liao ..... 84/422.1
7,301,088 B2 * 11/2007 Chen ..... 84/422.1
7,692,084 B1 * 4/2010 Lai ..... 84/422.1

* cited by examiner

*Primary Examiner*—Elvin G Enad
*Assistant Examiner*—Robert W Horn
(74) *Attorney, Agent, or Firm*—Charles E. Baxley

(57) ABSTRACT

A drum pedal assembly has a shaft, a bushing and a balancer. The shaft has a first end. The bushing is mounted securely around the first end and has two ends and a through hole. The through hole of the bushing is defined axially through the bushing and is mounted around the first end. The balancer is mounted securely around the bushing and has an outer surface, a shaft hole, a threaded hole and a bolt. The shaft hole is defined axially through the balancer and is mounted around the bushing. The threaded hole is mounted radially in the outer surface of the balancer and communicates with the shaft hole. The bolt is mounted in the threaded hole and presses against the shaft. When the bushing is worn, only the worn bushing has to be replaced.

5 Claims, 6 Drawing Sheets

DRUM PEDAL ASSEMBLY

BACKGROUND OF THE INVENTION

1. Field of the Invention

The present invention relates to instrumental hardware, and more particularly to a drum pedal assembly.

2. Description of Related Art

With reference to FIGS. 5 and 6, a conventional drum pedal assembly comprises a shaft (70), a balancer (80) and a beater (90). The shaft (70) has an outer surface. The balancer (80) is mounted around the outer surface of the shaft (70) and has an outer surface, a shaft hole (81), a threaded hole (82) and a bolt (83). The shaft hole (81) is defined axially through the balancer (80), is mounted around the outer surface of the shaft (70) and has an inner surface. The threaded hole (82) is defined radially in the outer surface of the balancer (80) and communicates with the shaft hole (81). The bolt (83) is mounted in the threaded hole (82) and presses against the outer surface of the shaft (70). The beater (90) is mounted securely on the shaft (70). Because the bolt (83) is used to press against and to fix the shaft (70), the beater (90) can be secured freely in a custom manner.

However, frequent pressing force applied to the shaft (70) by the bolt (83) easily damages the outer surface of the shaft (70), and a damaged shaft (70) has to be replaced with a new one. This is costly and inconvenient.

Also, damage to the outer surface of the shaft (70) prevents the bolt (83) from securely holding the shaft (70) at a desired angle, and causes relative rotation between the shaft (70) and the balancer (80).

Finally, friction between the outer surface of the shaft (70) and the inner surface of the shaft hole (81) is not sufficient so causing the relative rotation therebetween.

To overcome the shortcomings, the present invention tends to provide a drum pedal assembly to mitigate and obviate the aforementioned problems.

SUMMARY OF THE INVENTION

The main objective of the invention is to provide a drum pedal assembly that comprises a bushing that is replaceable to prevent a shaft from wearing or damaging.

A drum pedal assembly has a shaft, a bushing and a balancer. The shaft has a first end. The bushing is mounted securely around the first end and has two ends and a through hole. The through hole of the bushing is defined axially through the bushing and is mounted around the first end. The balancer is mounted securely around the bushing and has an outer surface, a shaft hole, a threaded hole and a bolt. The shaft hole is defined axially through the balancer and is mounted around the bushing. The threaded hole is mounted radially in the outer surface of the balancer and communicates with the shaft hole. The bolt is mounted in the threaded hole and presses against the shaft. When the bushing is worn, only the worn bushing has to be replaced instead of the shaft.

Other objects, advantages and novel features of the invention will become more apparent from the following detailed description when taken in conjunction with the accompanying drawings.

DETAILED DESCRIPTION OF PREFERRED EMBODIMENT

Figure 1:
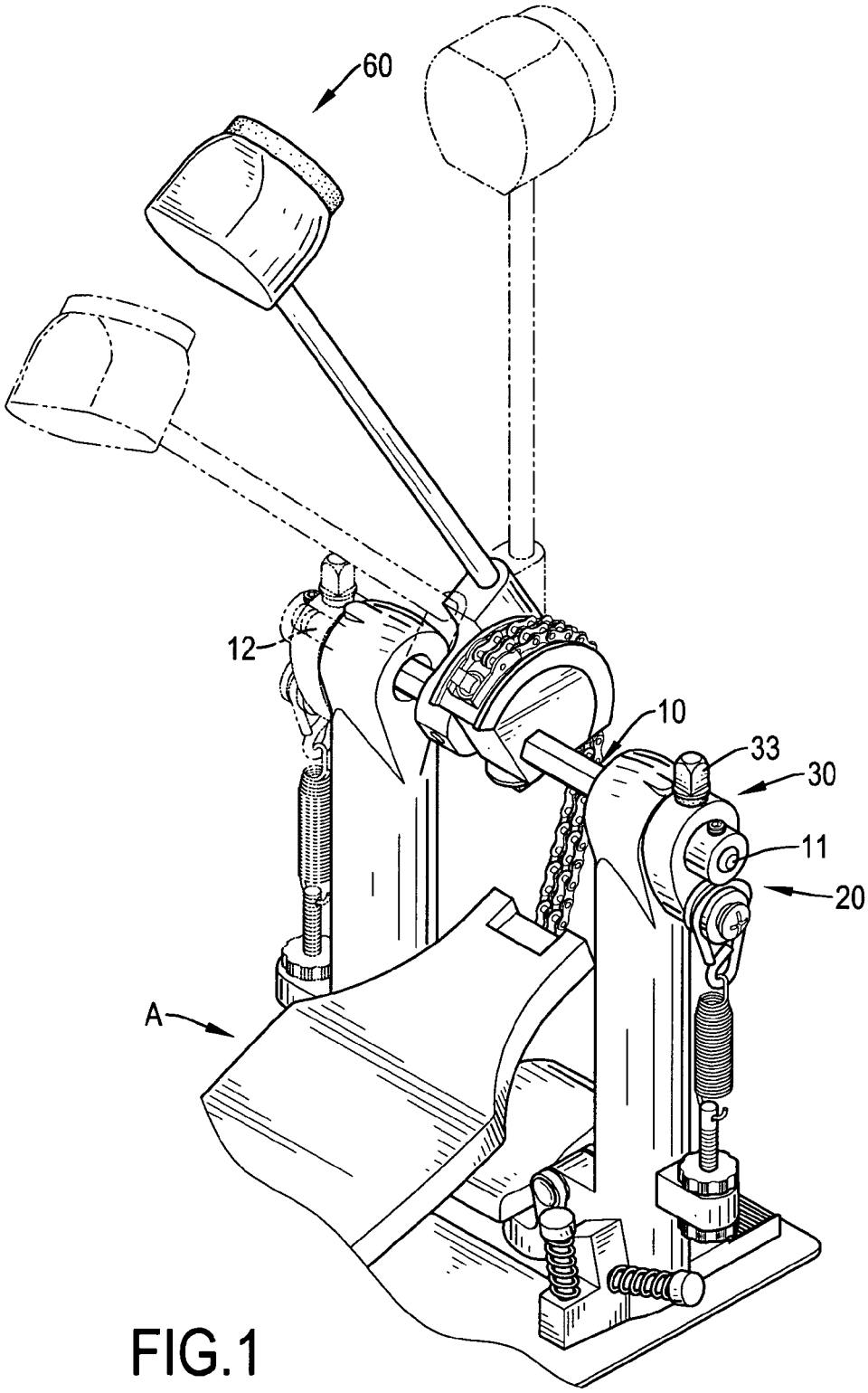
FIG. 1 is an operational partial perspective view of a drum pedal assembly in accordance with the present invention.
Figure 2:
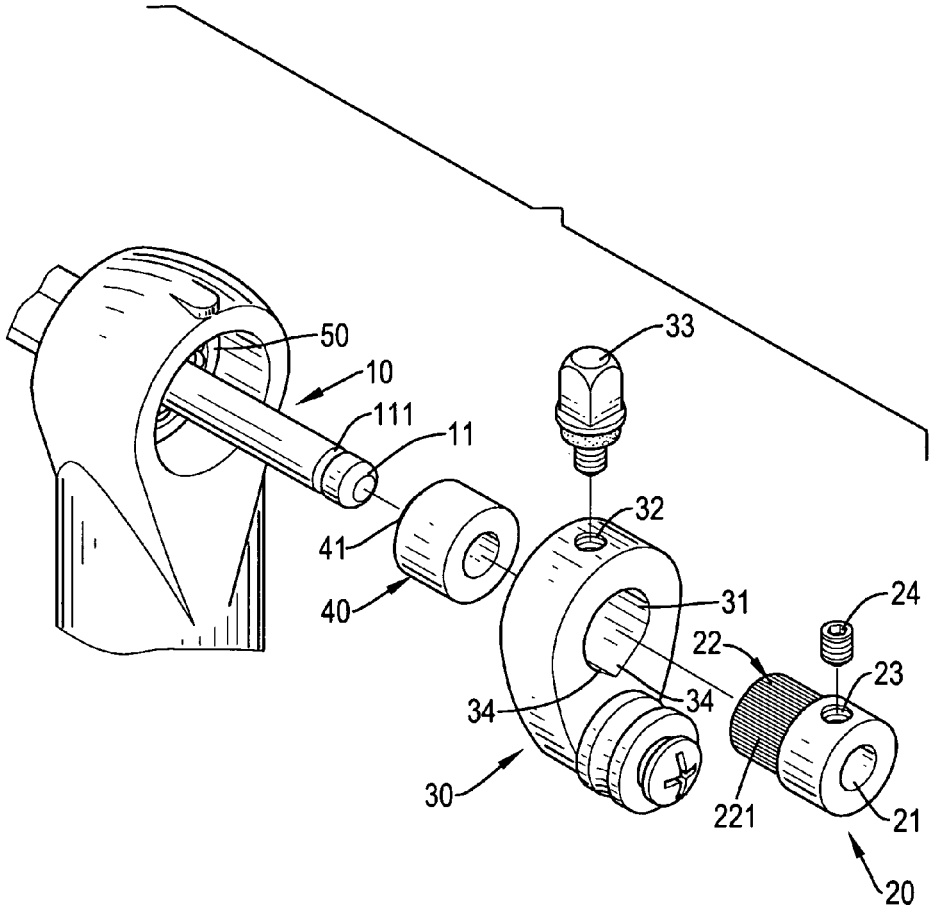
FIG. 2 is an enlarged partially exploded perspective view of the drum pedal assembly in FIG. 1.
Figure 3:
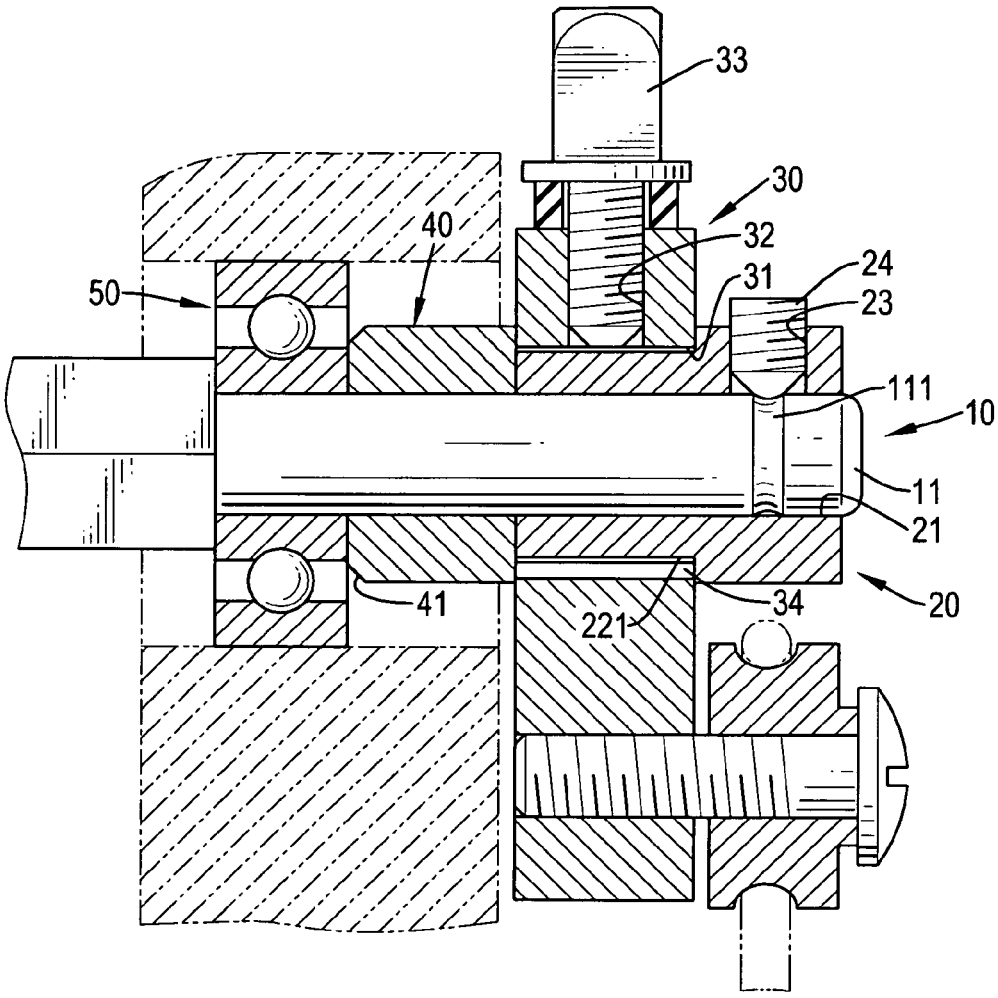
FIG. 3 is an enlarged side view in partial section of the drum pedal assembly in FIG. 1.

With reference to FIGS. 1 to 3, a drum pedal assembly in accordance with the present invention comprises a body (A), a shaft (10), a bushing (20), a balancer (30), a spacer (40), a bearing (50) and a beater (60).

The body (A) comprises a base, two pillars, a foot pedal and a chain drive. The pillars are mounted securely on the base. Each pillar has a through hole. The foot pedal is mounted movably on the base and between the pillars. The chain drive has two ends. One of the ends of the chain drive is mounted securely on the foot pedal. The structure of the body (A) may be conventional so detailed description of the body (A) is omitted.

Figure 6:
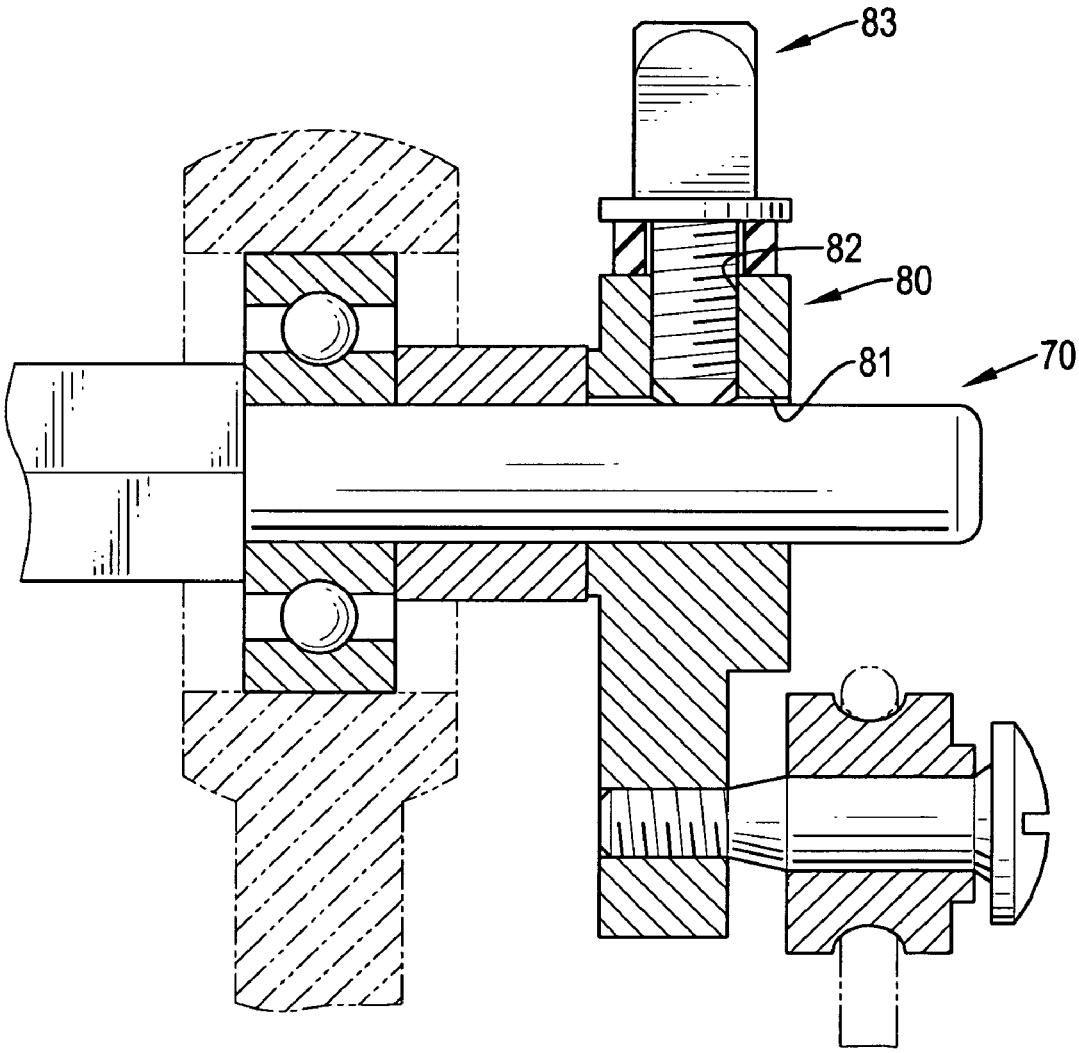
FIG.6 PRIOR ART
FIG. 6 is an enlarged side view in partial section of the conventional drum pedal assembly in FIG. 5.

The shaft (10) is mounted in the through holes of the pillars, is mounted with the end of the chain drive which is opposite to the end connected with the foot pedal and comprises a first end (11), a second end (12), an outer surface and a groove (111). The first end (11) has an outer surface. The groove (111) is annular and is defined around the outer surface of the first end (11). The bushing (20) is mounted securely around the outer surface of the first end (11) and has two ends, a maximum diameter, a through hole (21), a connecting section (22), a fixing hole (23) and a fixing element (24). Each end has an outer surface. The through hole (21) of the bushing (20) is defined axially through the bushing (20) and is mounted around the outer surface of the first end (11). The connecting section (22) is formed on one of the ends of the bushing (20) that faces the second end (12) of the shaft (10) and has an external diameter, an outer surface, and a coarse exterior (221). The external diameter of the connecting section (22) is smaller than the maximal diameter of the bushing (20). The coarse exterior (221) is defined around the outer surface of the connecting section (22). The fixing hole (23) is defined radially in the outer surface of the end of the bushing (20) which is opposite to the connecting section (22) and aligns with the groove (111). The fixing element (24) is mounted in the fixing hole (23) and presses against the shaft (10). Contact area between the fixing element (24) and the shaft (10) is larger than that between the conventional bolt (83) and shaft (70) as shown in FIG. 6. In the present invention, the bushing (20) may have multiple fixing holes (23) and multiple fixing elements (24). Fixing elements (24) are respectively mounted in the fixing holes (23). The present invention does not limit the number of the fixing holes (23).

Figure 4:
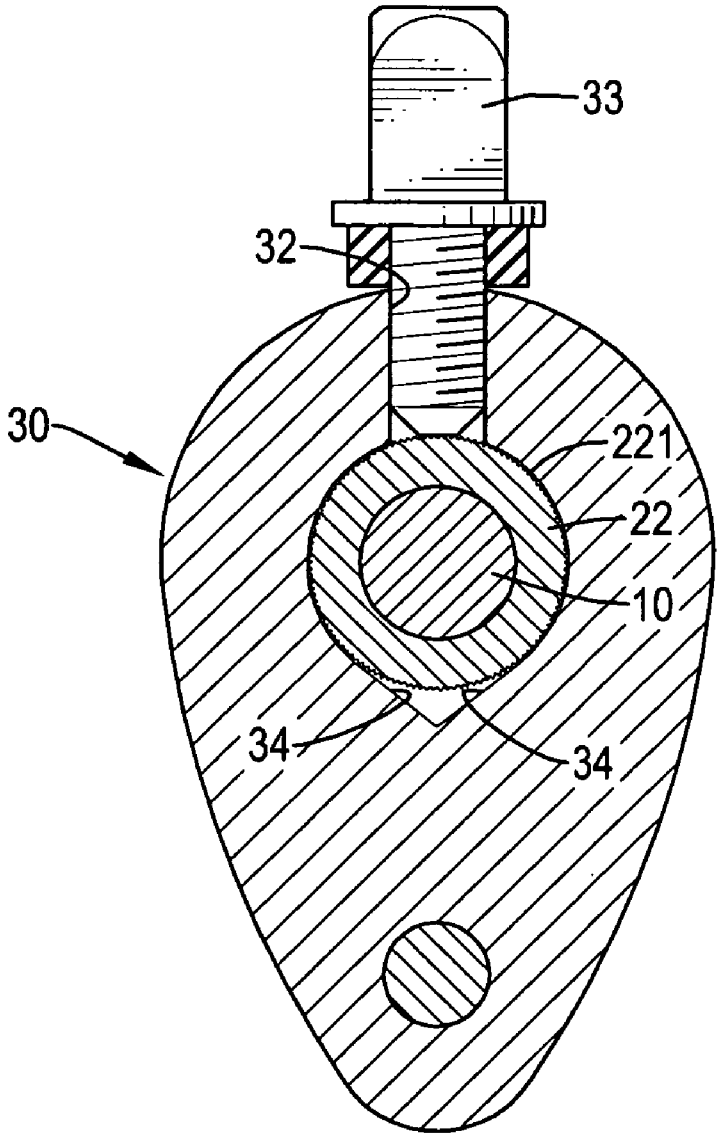
FIG. 4 is an enlarged end view in partial section of the drum pedal assembly in FIG. 1.
Figure 5:
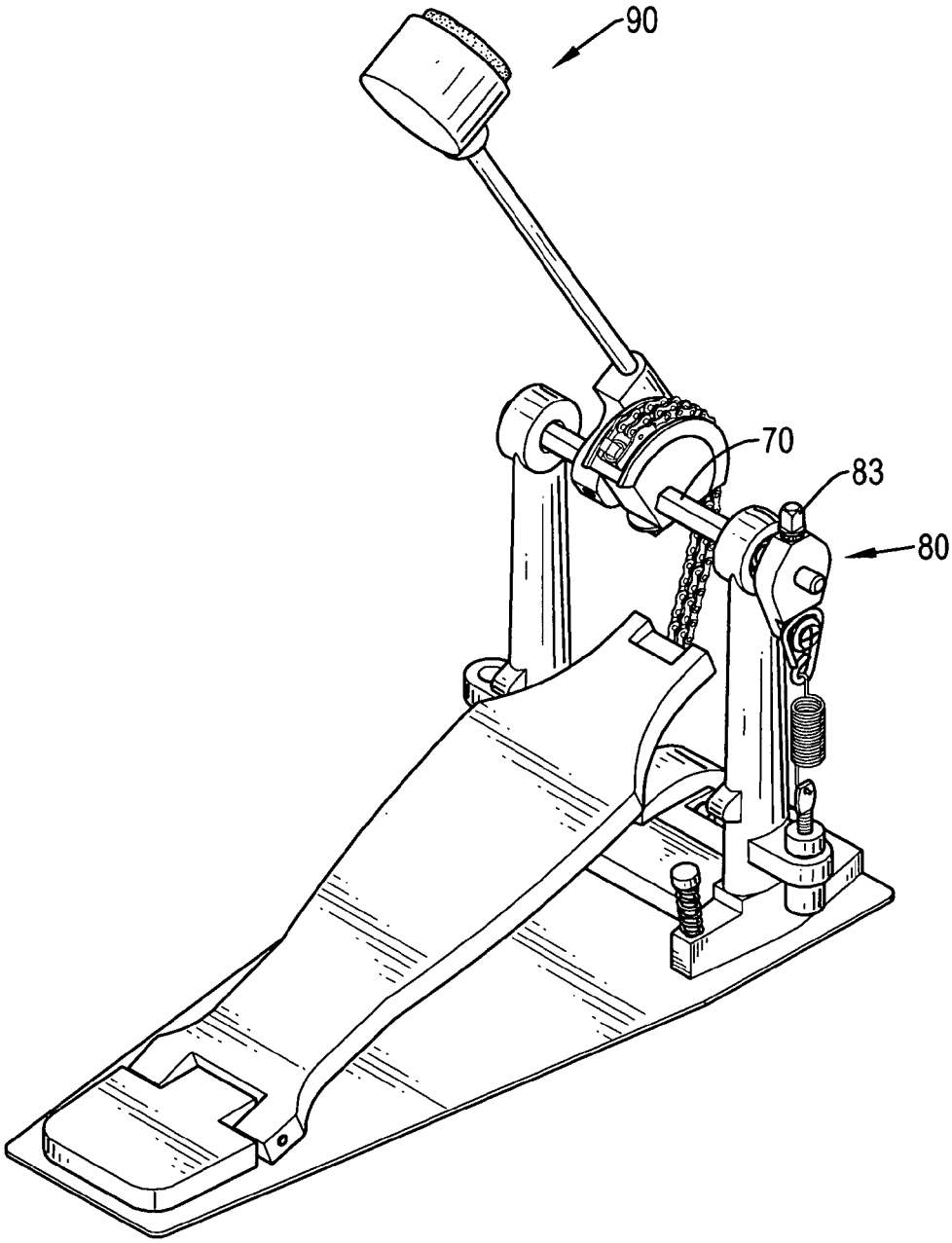
FIG.5 PRIOR ART
FIG. 5 is a perspective view of a conventional drum pedal assembly in accordance with the prior art.

With further reference to FIGS. 3 and 4, the balancer (30) is mounted securely around the outer surface of the connecting section (22) and has an outer surface; a shaft hole (31), a threaded hole (32), a bolt (33) and a pair of inclined planes (34). The shaft hole (31) is defined axially through the balancer (30), is mounted around the outer surface of the connecting section (22) and has an inner surface, an internal diameter and a shape. The inner surface of the shaft hole (31) has a bottom. The shape of the shaft hole (31) may be round or elliptical. The present invention does not limit the shape of the shaft hole (31). The threaded hole (32) is defined radially in the outer surface of the balancer (30) and communicates with the shaft hole (31). The bolt (33) is mounted in the threaded hole (32) to press against and to fix the connecting section (22). The inclined planes (34) are formed on the bottom of the inner surface of the shaft hole (31) and clamp the connecting section (22).

The spacer (40) is mounted around the outer surface of the shaft (10), is adjacent to the bushing (20), and has an outer end, a tapered end (41) and a maximum diameter. The outer end of the spacer (40) is adjacent to the connecting section (20). The maximum diameter of the spacer (40) is larger than the internal diameter of the shaft hole (31) so preventing the spacer (40) from slipping into the shaft hole (31). Since the maximum diameter of the spacer (40) is larger than the internal diameter of the shaft hole (31), the balancer (30) can be held securely in position, and lateral movement of the balancer (30) relative to the spacer (40) and the bushing (20) is prevented.

With reference to FIGS. 1 and 2, the bearing (50) is mounted securely in the through hole of one of the pillars, is mounted securely around the outer surface of the shaft (10), is adjacent to the tapered end (41) and has contact area between the tapered end (41) and the bearing (50). Since the tapered end (41) is tapered, contact area between the spacer (40) and the bearing (50) is reduced, and causes smaller worn area between the spacer (40) and the bearing (50) to prolong useful life of the bearing (50).

The beater (60) is mounted securely on the outer surface of the shaft (10) between the pillars. Because the bolt (33) presses against and fixes the connecting section (22) and the connecting section (22) is mounted securely on the shaft (10), the bolt (33) can secure the shaft (10) at any desired angle. Therefore, the beater (60) can be secured in a custom manner.

To assemble, the fixing element (24) is screwed into the fixing hole (23) and presses in the groove (111) against the shaft (10) and makes the bushing (20) clamp the shaft (10). Because contact area between the fixing element (24) and the shaft (10) is large, force between the fixing element (24) and the shaft (10) is sufficient to prevent relative rotation between the bushing (20) and the shaft (10). In addition, the groove (111) prevents lateral movement of the bushing (20) on the shaft (10). The bolt (33) is screwed into the threaded hole (32), presses against the connecting section (22) and makes the connecting section (22) press against the inclined planes (34). The coarse exterior (221) increases friction between the bolt (33) and the connecting section (22), and between the outer surface of the connecting section (22) and the inner surface of the shaft hole (31) so preventing relative rotation between the balancer (30) and the bushing (20). Moreover, the inclined planes (34) are intended to provide greater effect as the bolt (33) is tightened.

Because the bushing (20) is mounted between the balancer (30) and the shaft (10), the bolt (33) is kept from pressing against the shaft (10) directly. When the bushing (20) is worn, only the worn bushing (20) has to be replaced and replacing a new shaft (10) is unnecessary. This reduces maintenance costs of the drum pedal assembly.

The shaft (10) may have a second bushing, a second balancer mounted around the second bushing and a second spacer from the second end (12). The parts are mounted in sequence on the shaft (10) from the second end (12) and have structures the same as those mounted on the first end (11). The present invention may have the structure on the first end (11) or on the second end (12) or on both ends of the shaft (10).

From the above description, it is noted that the invention has the following advantages:

1. Low Maintenance Costs:

Because the bushing (20) is replaceable, the bushing (20) can be replaced instead of the shaft (10) when the bushing (20) is worn.

2. Relative-Rotation Proof:

The coarse exterior (221) is capable of increasing friction between the bolt (33) and the connecting section (22), and between the outer surface of the connecting section (22) and the inner surface of the shaft hole (31). This prevents relative rotation between the balancer (30) and the bushing (20). Because contact area between the fixing element (24) and the shaft (10) is large, force between the fixing element (24) and the shaft (10) is sufficient to prevent relative rotation between the bushing (20) and the shaft (10).

3. Stable Mounting:

The inclined planes (34) clamp the bushing (20) as the bolt (33) is tightened so the balancer (30) can be securely mounted on the bushing (20).

4. Lateral-Movement Proof:

The groove (111) is capable of preventing lateral movement of the bushing (20) along the shaft (10).

5. Longer Useful Life:

With the tapered end (41), contact area between the spacer (40) and the bearing (50) can be reduced. Reduced contact area causes a smaller worn area between the spacer (40) and the bearing (50) and prolongs useful life of the bearing (50).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A drum pedal assembly comprising:

a shaft having
- a first end;
- a second end; and
- an axial length being between the first end of the shaft and the second end of the shaft;

a bushing mounted securely around the first end of the shaft and having
- a flange section having an external diameter;
- a connecting section connected to the flange section and having
  - an axial length pointing to the second end of the shaft;
  - an outer surface;
  - a coarse exterior defined around the outer surface of the connecting section; and
  - an external diameter smaller than that of the flange section;
- a through hole defined axially through the flange section and the connecting section and mounted around the first end of the shaft;

a balancer mounted securely around the connecting section and having
- an outer surface;
- a shaft hole defined axially through the balancer, mounted around the connection section and having
  - an internal diameter;
  - an inner surface having a bottom; and a pair of inclined planes defined on the bottom of the inner surface of the shaft hole and clamping the connecting section;

a threaded hole defined radially in the outer surface of the balancer and communicating with the shaft hole; and a bolt mounted in the threaded hole and pressing against the coarse exterior; and a body having a base;

two pillars mounted securely on the base and through which the shaft is mounted;

a foot pedal mounted movably on the base and located between the pillars;

a chain drive having two ends respectively connected securely to the shaft and the foot pedal; and a beater mounted securely on the shaft between the pillars.

2. The drum pedal assembly as claimed in claim 1, wherein the flange section has an outer surface; and the bushing has at least one fixing hole defined radially in the outer surface of the flange section; and at least one fixing element mounted in the at least one fixing hole.

3. The drum pedal assembly as claimed in claim 2, wherein the first end of the shaft has an outer surface; and an annular groove defined around the outer surface of the first end of the shaft and aligning with the at least one fixing hole.

4. The drum pedal assembly as claimed in claim 3, wherein the drum pedal assembly comprises a spacer mounted around the shaft and adjacent to the connecting section and having an outer end adjacent to the connecting section and having an external diameter larger than the internal diameter of the shaft hole;

a tapered end;

an axial length being between the outer end of the spacer and the tapered end of the spacer; and a bearing mounted around the shaft and adjacent to the tapered end of the spacer.

5. The drum pedal assembly as claimed in claim 4, wherein the shaft in sequence has a second bushing, a second balancer mounted around the second bushing and a second spacer from the second end of the shaft.

* * * * *